US009103597B2

(12) United States Patent
Christensen et al.

(10) Patent No.: US 9,103,597 B2
(45) Date of Patent: Aug. 11, 2015

(54) PLATE HEAT EXCHANGER

(75) Inventors: Rolf Christensen, Veberöd (SE); Fredrik Andreasson, Södra Sandby (SE); Rolf Bermhult, Lund (SE); Håkan Larsson, Kävlinge (SE); Magnus Svensson, Marieholm (SE)

(73) Assignee: ALFA LAVAL CORPORATE AB, Lund (SE)

( * ) Notice: Subject to any disclaimer, the term of this patent is extended or adjusted under 35 U.S.C. 154(b) by 573 days.

(21) Appl. No.: 12/933,721

(22) PCT Filed: Apr. 4, 2008

(86) PCT No.: PCT/SE2008/050397

§ 371 (c)(1), (2), (4) Date: Oct. 21, 2010

(87) PCT Pub. No.: WO2009/123517

PCT Pub. Date: Oct. 8, 2009

(65) Prior Publication Data

US 2011/0024097 A1 Feb. 3, 2011

(51) Int. Cl.
*F28F 3/08* (2006.01)
*F28D 9/00* (2006.01)
(Continued)

(52) U.S. Cl.
CPC ..... *F28D 9/005* (2013.01); *F28F 3/046* (2013.01); *F28D 2021/0084* (2013.01); *F28D 2021/0085* (2013.01); *F28F 2225/04* (2013.01); *F28F 2275/04* (2013.01)

(58) Field of Classification Search
USPC ..... 165/167, 164, 165, 166
See application file for complete search history.

(56) References Cited

U.S. PATENT DOCUMENTS 3,720,071 A * 3/1973 Nasser et al. ..... 165/166
4,099,928 A * 7/1978 Norback ..... 29/890.039
(Continued)

FOREIGN PATENT DOCUMENTS

DE 10 2004 003790 8/2005
FR 2 850 740 8/2004
(Continued)

OTHER PUBLICATIONS

Decision on Grant for RU application No. 2010145170 dated Feb. 2, 2012.
(Continued)

*Primary Examiner* — Marc Norman
*Assistant Examiner* — Jon T Schermerhorn
(74) *Attorney, Agent, or Firm* — Buchanan Ingersoll & Rooney PC

(57) ABSTRACT

A plate heat exchanger includes a plurality of heat exchanger plates formed of a metal sheet and permanently joined to each other by means of a braze material to form a plate package having first plate interspaces and second plate interspaces. Each heat exchanger plate has a pattern forming a heat transfer area and a plurality of porthole areas. Each heat exchanger plate extends along a main extension plane. The areas extend, on one side of the heat exchanger plate, between a primary level at a distance from the main extension plane and a secondary level at a distance from and on an opposite side of the main extension plane. Each heat exchanger plate has a depth defined by the distance between the primary level and the secondary level. The depth is equal to or less than 1.0 mm.

11 Claims, 8 Drawing Sheets

(51) Int. Cl.
*F28F 3/04* (2006.01)
*F28D 21/00* (2006.01)

(56) References Cited

U.S. PATENT DOCUMENTS

| | | | | |
|---|---|---|---|---|
| 4,489,778 | A * | 12/1984 | Skoog | 165/166 |
| 4,987,955 | A * | 1/1991 | Bergqvist et al. | 165/167 |
| 5,988,269 | A | 11/1999 | Karlsson et al. | |
| 6,394,179 | B1 | 5/2002 | Blomgren et al. | |
| 6,596,229 | B2 * | 7/2003 | Lin et al. | 420/502 |
| 7,246,436 | B2 * | 7/2007 | Blomgren et al. | 29/890.039 |
| 2005/0178536 | A1 | 8/2005 | Blomgren et al. | |
| 2007/0006998 | A1 * | 1/2007 | Brost | 165/167 |
| 2007/0107890 | A1 | 5/2007 | Geskes et al. | |
| 2008/0029257 | A1 * | 2/2008 | Nilsson | 165/167 |

FOREIGN PATENT DOCUMENTS

| | | | |
|---|---|---|---|
| JP | 10-096595 | | 4/1998 |
| JP | 2001-133193 | | 5/2001 |
| JP | 2002-107074 | A | 4/2002 |
| JP | 2002-246494 | | 8/2002 |
| JP | 2002-539407 | | 11/2002 |
| JP | 2004-508525 | | 3/2004 |
| JP | 2005-514576 | | 5/2005 |
| JP | 2007-127306 | | 5/2007 |
| JP | 2007-518955 | | 7/2007 |
| JP | 2007-518955 | A | 7/2007 |
| JP | 2007-528978 | | 10/2007 |
| SU | 974090 | A1 | 11/1982 |
| SU | 1343233 | A1 | 10/1987 |
| WO | 00/53989 | | 9/2000 |
| WO | WO 01/69157 | | 9/2001 |
| WO | 03/058142 | | 7/2003 |
| WO | 2005/071342 | A1 | 8/2005 |
| WO | WO 2005/073658 | | 8/2005 |
| WO | 2005/088221 | | 9/2005 |
| WO | 2006/073135 | A1 | 7/2006 |
| WO | 2008/029185 | A2 | 3/2008 |

OTHER PUBLICATIONS

Form PCT/IB/326 for PCT/SE2008/050397, Notification of Transmittal of the IPRP (Oct. 14, 2010).
Form PCT/IB/373 for PCT/SE2008/050397, International Preliminary Report on Patentability (IPRP) (Oct. 5, 2010).
Form PCT/ISA/237 for PCT/SE2008/050397, Written Opinion of the International Searching Authority (ISA) (Jan. 23, 2009).
Office Action (Rejection Notice) for Korean Patent Application No. 10-2010-7022079 issued Nov. 9, 2012 with English translation.
Office Action (Rejection Notice) for Japanese Patent Application No. 2011-502891 dated Jul. 17, 2012 with English translation.
European Search Report issued on Apr. 22, 2013 by European Patent Office in corresponding European Patent Application No. 08741887.
Office Action issued on Mar. 4, 2013 by Japan Patent Office in corresponding Japanese Patent Application No. 2011-502891, and an English Translation thereof.
European Search Report issued Feb. 27, 2014 by the European Patent Office in corresponding European Patent Application No. 08741887.
Japanese Rejection Notice issued Jul. 1, 2014 by the Japanese Patent Office in corresponding Japanese Patent Application No. 2013-145716 and English language translation (6 pages).
European Office Action dated Nov. 10, 2014 issued in the corresponding European Patent Application No. 08741887.7-1602 (4 pages).

* cited by examiner

PLATE HEAT EXCHANGER

THE FIELD OF THE INVENTION

The present invention refers to a plate heat exchanger.

In many heat exchanger applications, it is desirable to achieve a high, or a very high, design pressure, i.e. to be able to permit a high, or a very high, pressure of one or both of the media flowing through the plate interspaces. It is also desirable to be able to permit such high pressures in plate heat exchangers of the kind defined above having permanently joined heat exchanger plates, e.g. through brazing. Such high design pressures are difficult to achieve without the provision of external strengthening components.

A weak area in such plate heat exchangers is the porthole area, i.e. the area immediately around the portholes. These areas determine the design pressure in plate heat exchangers used today. However, although a certain design of the porthole area would improve the design pressure, this design would not improve the strength at another area of the plate heat exchanger, i.e. the problem would then merely be displaced.

One example of an application which requires very high design pressures is plate heat exchangers for evaporators and condensers in cooling circuits having carbon dioxide as a cooling agent. Carbon dioxide is in this context very advantageous from an environmental point of view in comparison with traditional cooling agents, such as freons.

SUMMARY OF THE INVENTION

The object of the present invention is to provide a plate heat exchanger having a high design pressure, and more precisely a plate heat exchanger permitting a very high pressure of at least one of the media flowing therethrough.

This object is achieved by the plate heat exchanger initially defined, which is characterised in that the depth is equal to or less than 1.0 mm.

Such a small depth of the heat exchanger plates improves the strength of the plate and the plate heat exchanger. The small depth of the heat exchanger plates permits a small distance between corrugation elements, such as ridges and valleys, on the heat transfer area. Such a small distance between the corrugation elements means that the distance between the contact areas or joining areas between adjacent heat exchanger plates in the plate package also will be relatively short. Consequently, a small depth results in a small distance between the joining areas, and thus in a large number of such joining areas over the heat transfer area.

According to an embodiment of the invention, the depth is equal to or less than 0.9 mm, more preferably equal to or less than 0.85 mm, and most preferably equal to or less than 0.80 mm.

According to a further embodiment of the invention, each heat exchanger plate, before the forming, has a metal sheet thickness t, which lies in the range of $0.2 \leq t \leq 0.4$ mm. Advantageously, the metal sheet thickness t is approximately 0.3 mm.

According to a further embodiment of the invention, the braze material has a braze volume with respect to the heat exchanger area of the plate heat exchanger, wherein the first interspaces and the second interspaces have an interspace volume with respect to the heat transfer area of the plate heat exchanger and wherein the proportion of the braze volume to the interspace volume is at least 0.05. Such a relatively large volume of braze material enhances the strength of the joining between the heat exchanger plates, and thus the strength of the plate heat exchanger According to a further embodiment of the invention, each heat exchanger plate defines a longitudinal centre line, wherein the heat transfer area comprises ridges and valleys arranged in such a manner that the ridges of one of the heat exchanger plates abut the valleys of an adjoining one of the heat exchanger plates to form a plurality of joining areas. Advantageously, the ridges and valleys extend along at least an extension line forming an angle $\alpha$ of inclination with the centre line, wherein the angle $\alpha$ of inclination lies in the range $20 \leq \alpha \leq 70°$. Preferably, the angle $\alpha$ of inclination is approximately 45°. Such an angle $\alpha$ of inclination provides a maximum of joining areas, and thus contributes to a high strength of the plate package and the plate heat exchanger.

According to a further embodiment of the invention, the extension line of each ridge and valley forms a positive angle $\alpha$ of inclination at one side of the centre line and a corresponding negative angle of inclination at the other side of the centre line, wherein the ridges and valleys form joining areas at the centre line. Such joining areas at the centre line provide a high strength in this area.

According to a further embodiment of the invention, the ridges are disposed at a distance from and extend in parallel with each other. Advantageously, the distance between adjacent ridges on the heat transfer area is less than 4 mm. Such a small distance between adjacent ridges is advantageous as explained above and contributes to a large number of joining areas at the heat transfer area. Advantageously, this distance may be approximately 3 mm.

According to a further embodiment of the invention, each porthole area comprises a first porthole area, a second porthole area, a third porthole area and a fourth porthole area.

BRIEF DESCRIPTION OF THE DRAWINGS

The present invention will now be explained more closely by means of a description of various embodiments and with reference to the drawings attached hereto.

DETAILED DESCRIPTION OF VARIOUS EMBODIMENTS OF THE INVENTION

Figure 1:
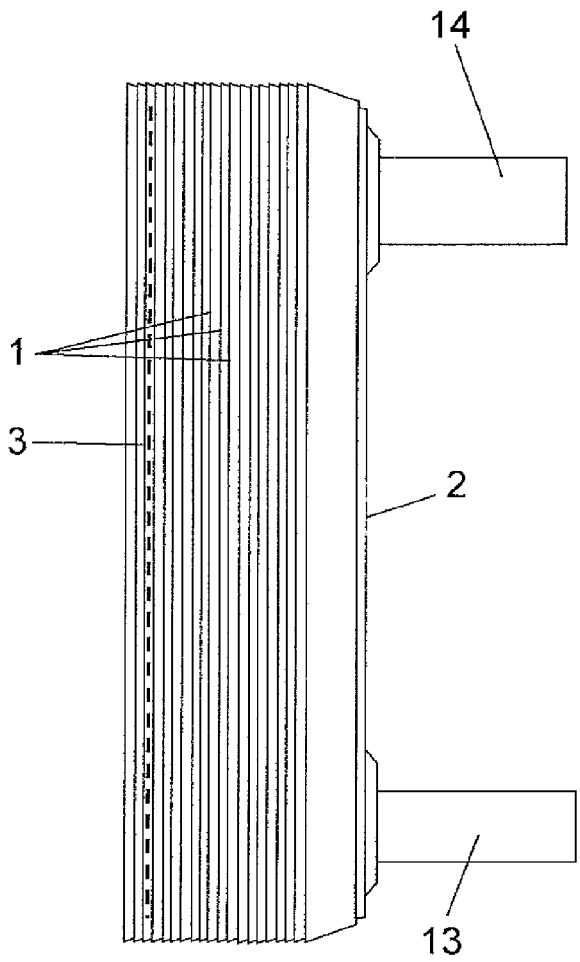
FIG. 1 shows a side view of a plate heat exchanger according to the invention.
Figure 2:
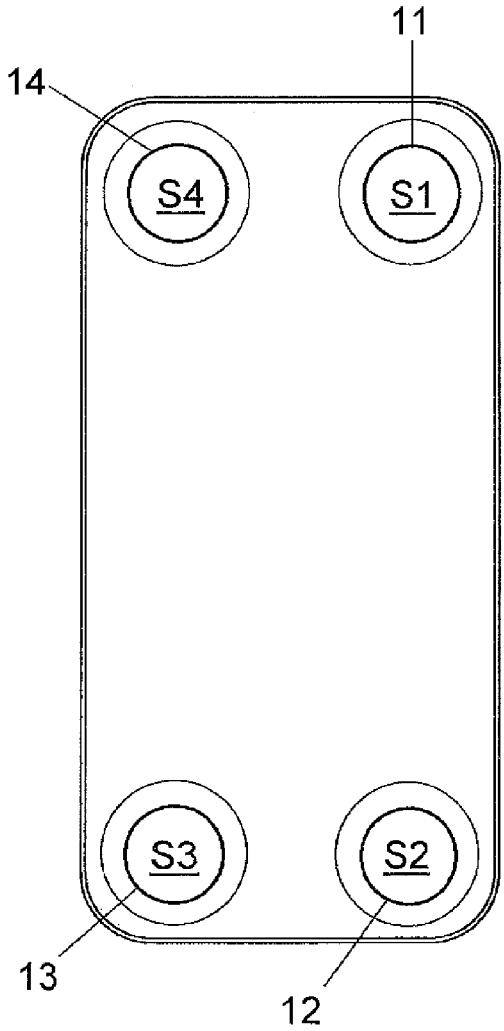
FIG. 2 shows a plan view of the plate heat exchanger in FIG. 1.

FIGS. 1 and 2 shows a plate heat exchanger comprising a plurality of heat exchanger plates 1, a first end plate 2, which is provided beside an outermost one of the heat exchanger plates 1, and a second end plate 3, which is provided beside the other opposite outermost heat exchanger plate 1.

The heat exchanger plates 1 are produced through forming of a metal sheet and provided beside each other. The first end plate 2, the second end plate 3 and the heat exchanger plates 1 are permanently joined to each other through brazing by means of a braze material to form a plate package. The plate package define or have first plate interspaces 4 for a first medium and second plate interspaces 5 for a second medium, see FIG. 6. The first and second medium may be any suitable heat transfer medium. For instance, the first and/or the second medium may be carbon dioxide.

The plate heat exchanger of the embodiments disclosed has four portholes S1, S2, S3 and S4, wherein the porthole S1 is connected to a connection pipe 11 and communicates with the first plate interspaces 4, the porthole S2 is connected to a connection pipe 12 and communicates with the first plate interspaces 4, the porthole S3 is connected to a connection pipe 13 and communicates with the second plate interspaces 5 and the porthole S4 is connected to a connection pipe 14 and communicates with the second plate interspaces 5. It is to be noted that the plate heat exchanger may have another number of portholes than those disclosed, e.g. 2, 3, 5, 6, 7 or 8 portholes. Connection pipes may be provided extending from the first end plate 2, as disclosed, and/or from the second end plate 3.

Figure 3:
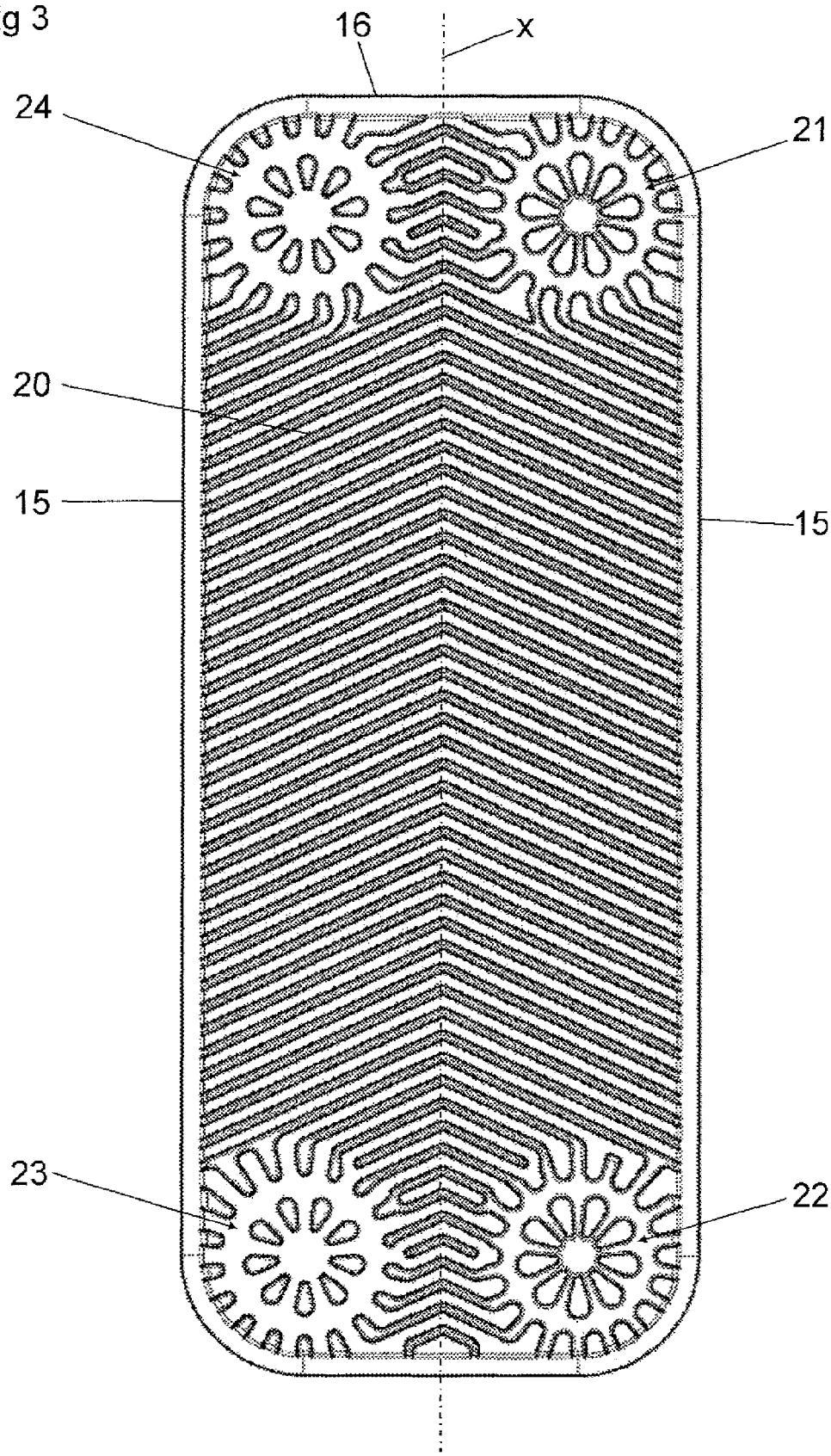
FIG. 3 shows a plan view of a heat exchanger plate of the plate heat exchanger in FIG. 1.

Each heat exchanger plate 1 has, in the embodiments disclosed, a rectangular shape with two long side edges 15 and two short side edges 16, see FIG. 3. A longitudinal centre axis x extends between and in parallel with the two long side edges 15 and transversely to the short side edges 16. Each heat exchanger plate 1 also extends along a main extension plane p, see FIG. 6.

Figure 4:
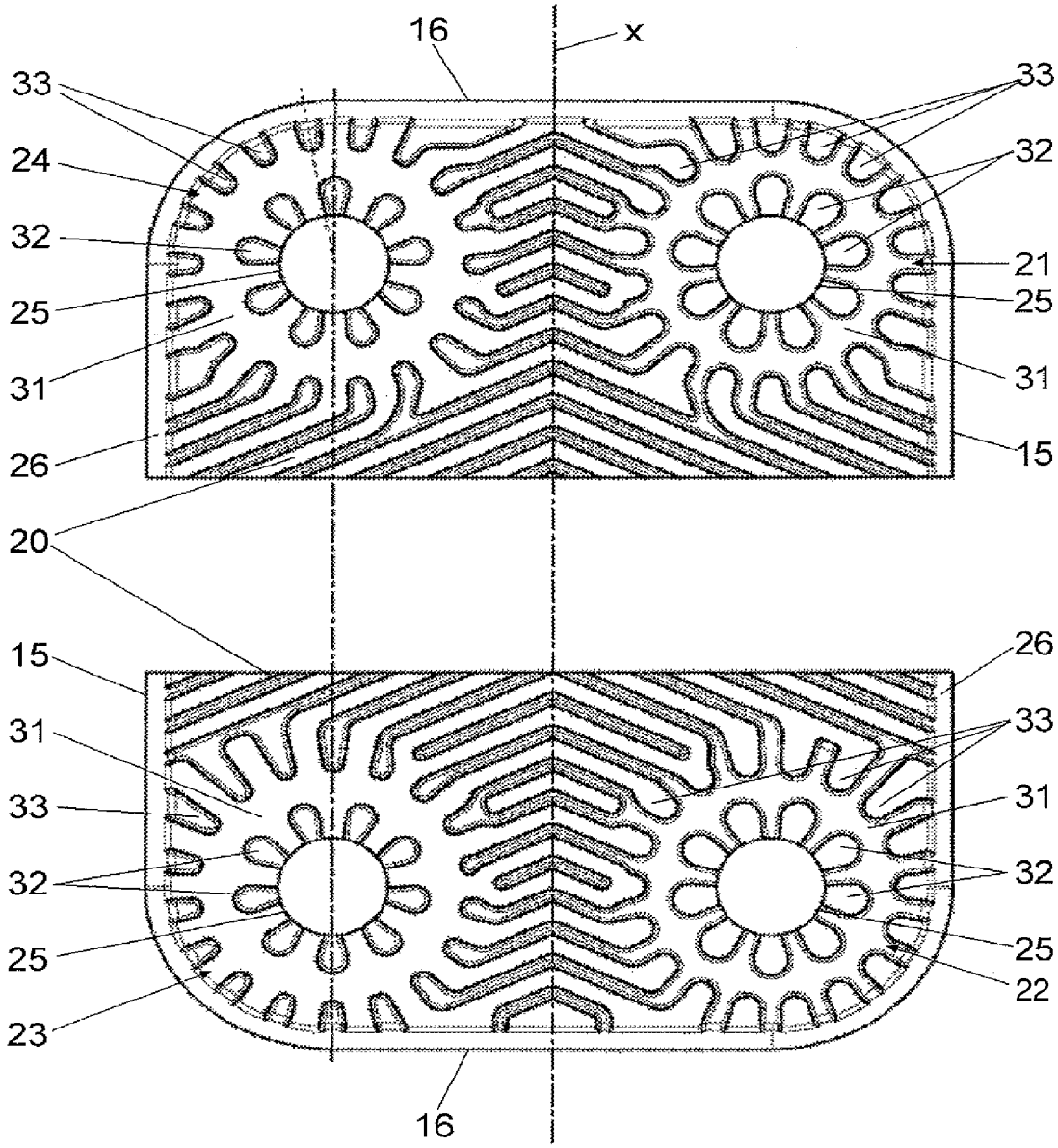
FIG. 4 shows another plan view of a heat exchanger plate of the plate heat exchanger in FIG. 1.

As can be seen from FIGS. 3 and 4, each heat exchanger plate 1 has a heat transfer area 20, at which the main part of the heat transfer between the first and second media take place, and a plurality of porthole areas 21-24. In the embodiments disclosed, the porthole areas 21-24 comprise a first porthole area 21, a second porthole area 22, a third porthole area 23 and a fourth porthole area 24. Each porthole area 21-24 surrounds a respective porthole through the heat exchanger plate 1. Each porthole is defined by a porthole edge 25.

Figure 6:
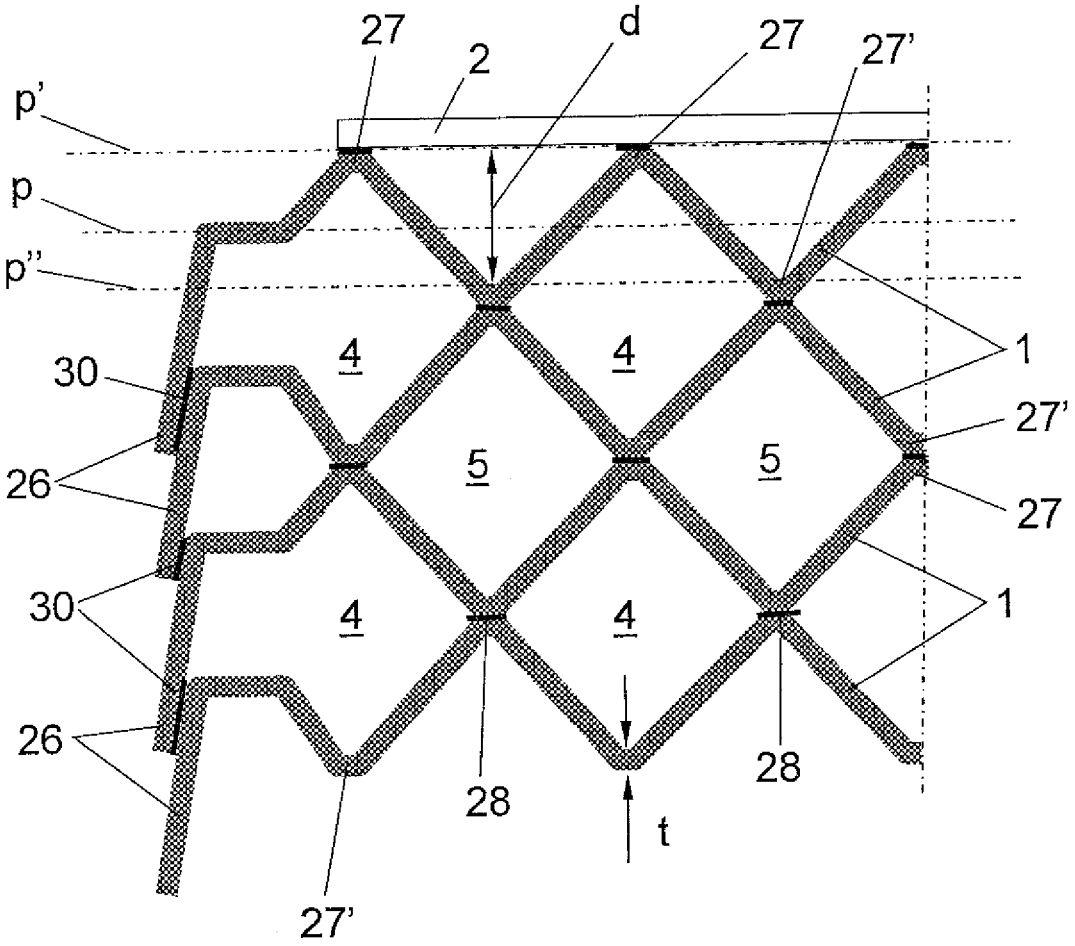
FIG. 6 shows a cross-sectional view through some of the heat exchanger plates at a heat transfer area of the plate heat exchanger in FIG. 1.

All of the areas 20-24 extend, on one side of the heat exchanger plate 1, between a primary level p' at a distance from the main extension plane p, and a secondary level p" at a distance from and on an opposite side of the main extension plane p, see FIG. 6. With respect to said one side of the heat exchanger plate 1, the primary level p' forms an upper level of the heat exchanger plate 1, and the secondary level p" forms a lower level of the heat exchanger plate 1 as seen in FIG. 6. The primary level p' is thus located more closely to the first end plate 2 than the secondary level p". Each heat exchanger plate 1 also has a flange 26 extending around the heat exchanger plate 1 along the long side edges 15 and the short side edges 16. As can be seen in FIG. 6, the flange 26 extends further away from the main extension plane p than the secondary level p".

Each heat exchanger plate 1 is made through forming of a metal sheet having a metal sheet thickness t. It is to be noted that the metal sheet thickness t may vary and be somewhat changed after the forming of the heat exchanger plate 1. The metal sheet thickness t, before the forming, may lie in the range $0.2 \leq t \leq 0.4$ mm. Advantageously, the metal sheet thickness t, before the forming, may be 0.3 mm or approximately 0.3 mm.

Each heat exchanger plate 1 also has a depth d, see FIG. 6. The depth d is defined by the distance between the primary level p' and the secondary level p". The depth d may be equal to or less than 1.0 mm, preferably equal to or less than 0.90 mm, more preferably equal to or less than 0.85 mm or most preferably equal to or less than 0.80 mm.

Figure 7:
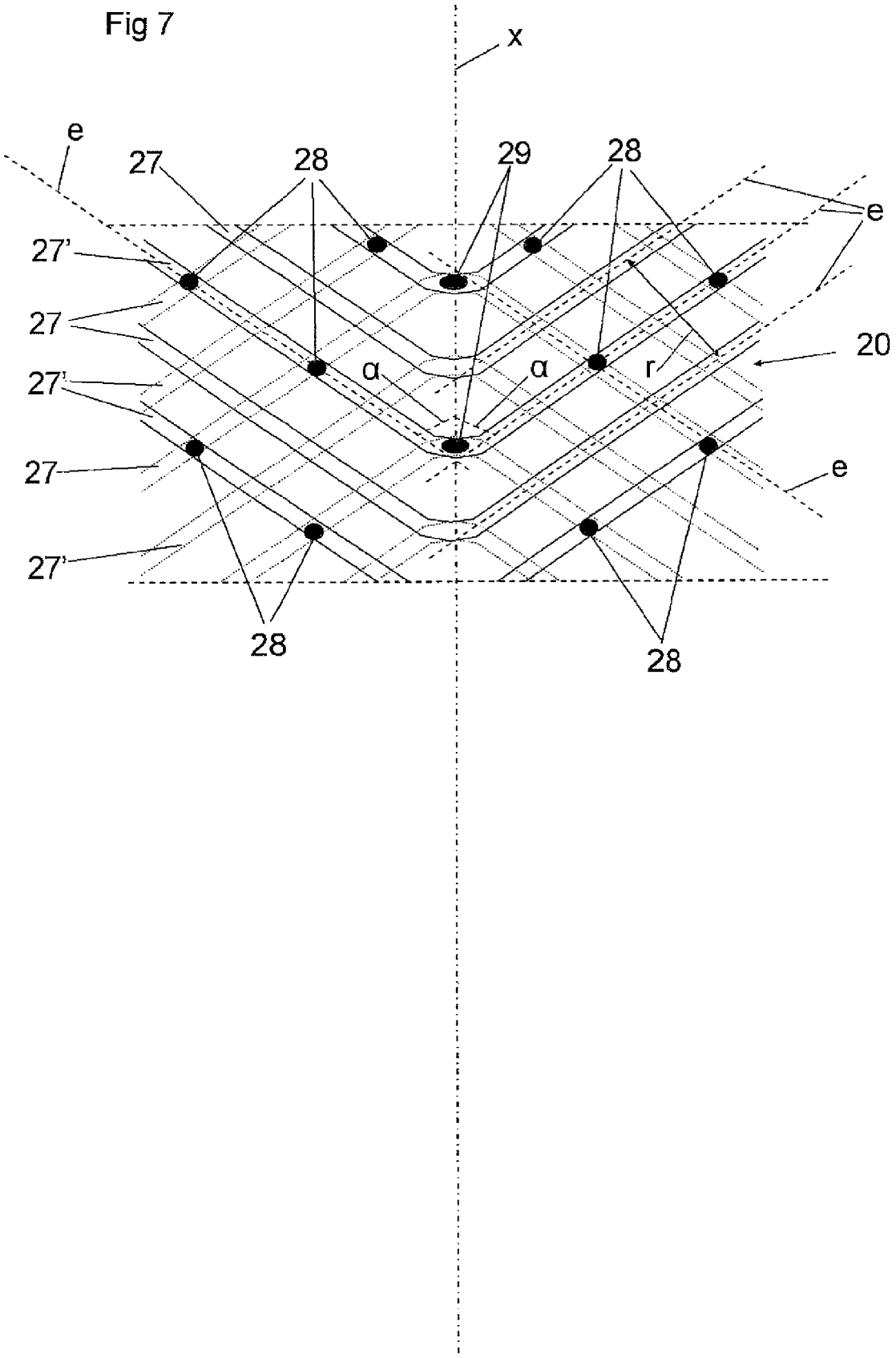
FIG. 7 shows a plan view of a part of the heat transfer area of a heat exchanger of the plate heat exchanger in FIG. 1.

As can be seen in FIGS. 3, 6 and 7, the heat transfer area 20 comprises a corrugation of ridges 27 and valleys 27' arranged in such a manner that the ridges 27 of one of the heat exchanger plates 1 abut the valleys 27' of an adjoining one of the heat exchanger plates 1 to form a plurality of joining areas 28 between a heat exchanger plate 1, indicated with full lines in FIG. 7, and an adjacent heat exchanger plate 1, indicated with dotted lines in FIG. 7. The ridges 27 are disposed at a distance r form each other, and extend in parallel with each other and with the valleys 27'.

The ridges 27 and valleys 27' extend along an extension line e forming an angle $\alpha$ of inclination with the centre line x, see FIG. 7. The angle $\alpha$ of inclination may lie in the range $20° \leq \alpha \leq 70°$. Advantageously, the angle $\alpha$ of inclination may be 45°, or approximately 45°. In the embodiments disclosed, the extension line e of each ridge 27 and valley 27' forms a positive angle $\alpha$ of inclination at one side of the centre line x and a corresponding negative angle $\alpha$ of inclination at the other side of the centre line x. As can be seen in FIG. 7, the ridges 27 and valleys 27' also form joining areas 29 at the centre line x. Furthermore, joining areas 30 are formed between the flanges 26 of adjacent heat exchanger plates 1. The distance r between adjacent ridges 27, or between a respective central extension line e of adjacent ridges 27, may be less than 4 mm, or may be approximately 3 mm, or 3 mm, see FIG. 7.

As mentioned above the plate heat exchanger is brazed by means of a braze material introduced between the heat exchanger plates 1 before the brazing operation. The braze material has a braze volume with respect to the heat transfer area 20 of the plate heat exchanger. The first interspaces 4 and the second interspaces 5 of the plate heat exchanger have an interspace volume with respect to the heat transfer area 20 of the plate heat exchanger. In order to obtain a high strength of the plate heat exchanger, it is advantageous to provide a sufficiently large quantity of braze material forming the above-mentioned joining areas 28, 29 between adjacent heat exchanger plates 1. Consequently, the proportion of the braze volume to the interspace volume may be at least 0.05, at least 0.06, at least 0.08 or at least 0.1.

Each porthole area 21-24 comprises an annular flat area 31, a set of inner portions 32 disposed on the annular flat area 31 and distributed along the porthole edge 25. The inner portions 32 are displaced from the annular flat area 31 in a normal direction with respect to the main extension plane p. Each porthole area 21-24 also comprises a set of outer portions 33 disposed on and distributed along the annular flat area 31 at a distance from the inner portions 32. The inner portions 32, which adjoin the porthole edge 25, extend to or are located at the same level as the outer portions 33, whereas the annular flat area 31 is located at another level than the inner portions 32 and the outer portions 33. More specifically, the inner portions 32 and the outer portions 33 of the first porthole area 21 and the second porthole area 22 extend to or are located at the secondary level p", whereas the annular flat area 31 of the first porthole area 21 and the second porthole area 22 is located at the primary level p'. Furthermore, the inner portions 32 and the outer portions 33 of the third porthole area 23 and the fourth porthole area 24 extend to or are located at the primary level p', whereas the annular flat area 31 of the third porthole area 23 and the fourth porthole area 24 is located at the secondary level p". Each inner portion 32 have a flat extension at the respective level p' and p", and each outer portion 33 have a flat extension at the respective level p' and p". This means that the flat extension of the inner portions 32 and the outer portions 33 of the first and second porthole areas 21, 22 is located at the secondary level p", whereas the flat extension of the inner portions 32 and the outer portions 33 of the third porthole area 23 and the fourth porthole area 24 is located at the primary level p'.

In the plate package, every second heat exchanger plate 1 is rotated 180° in the main extension plane p. This means that the inner portions 32 of one heat exchanger plate 1 will adjoin and be joined to a respective one of the inner portions 32 of an adjacent heat exchanger plate 1. In the same way, the outer portions 33 of one heat exchanger plate 1 will adjoin and be joined to a respective one of the outer portions 33 of an adjacent heat exchanger plate 1. More specifically, the inner portions 32 and the outer portions 33 of the first porthole area 21 of one heat exchanger plate 1 will be joined to a respective one of the inner portions 32 and the outer portions 33 of the third porthole area 23 of an adjacent heat exchanger plate 1 in the plate package. In the same way, the inner portions 32 and the outer portions 33 of the second porthole area 22 of one heat exchanger plate 1 will be joined a respective one of the inner portions 32 and the outer portions 33 of the fourth porthole area 24 of an adjacent heat exchanger plate 1 in the plate package of the embodiment disclosed.

Figure 5:
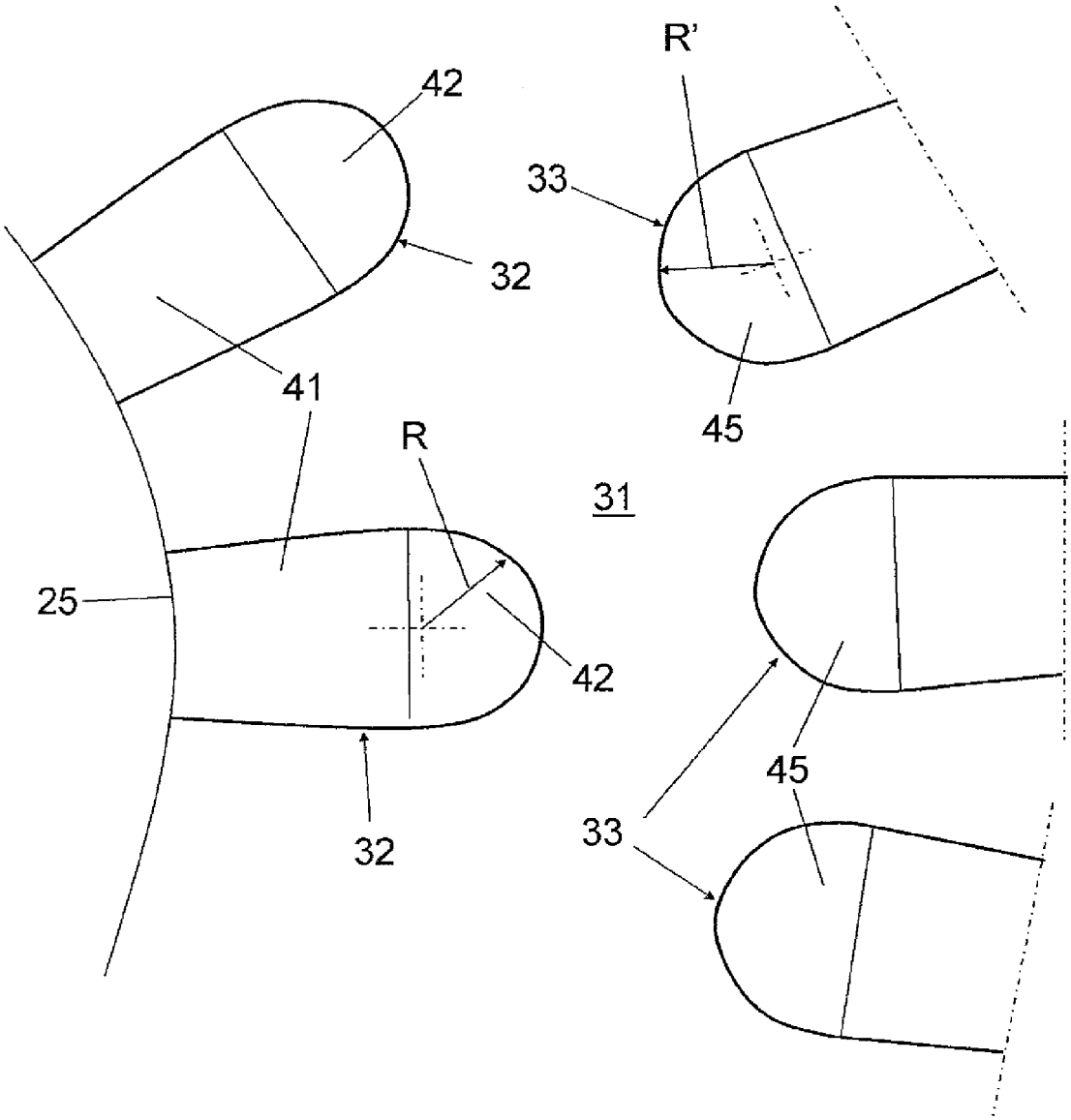
FIG. 5 shows a plan view of a part of a porthole area of the heat exchanger plate in FIG. 4.

As can be seen in FIG. 5, each inner portion 32 has an inner part 41 extending to and adjoining the porthole edge 25. Moreover, each inner portion 32 has an outer segment 42 adjoining the inner part 41 and having an angular extension of at least 180°. The outer segment 42 adjoins the annular flat portion 31. The outer segment 42 has a continuous contour and a radius R. The radius R is substantially constant and allowed to vary within the range of 0.8 R≤R≤1.2 R, more specifically within the range 0.9 R≤R≤1.1 R, and most specifically within the range of 0.95 R≤R≤1.05 R.

Furthermore, each of the outer portions 33 may have an inner segment 45 adjoining the annular flat area 31 and having an angular extension of at least 90°, at least 120°, or at least 150°. The inner segment 45 preferably also has a continuous contour, and may have a radius R', which is constant or substantially constant, and allowed to vary within a range 0.8 R'≤R'≤1.2 R', more specifically within the range 0.9 R≤R≤1.1 R, and most specifically within the range of 0.95 R≤R≤1.05 R.

As can be seen in FIG. 4, both the inner portions 32 and the outer portions 33 of each porthole area 21-24 are uniformly distributed around the respective porthole. More specifically, the inner portions 32 present an equal inner angular distance between adjacent inner portions 32. The outer portions 33 present an equal outer angular distance between adjacent outer portions 33. Furthermore, the outer portions 33 of the first porthole area 21 and the third porthole area 23 have a first relative peripheral position with respect to the inner portions 32 of these two porthole areas 21 and 23. The outer portions 33 of the second porthole area 22 and the fourth porthole area 24 have a second relative peripheral position with respect of the inner portions 32 of these two porthole areas 22 and 24. It can be seen from FIG. 4 that the first relative peripheral position is displaced peripherally, or includes a peripheral displacement, in relation to the second relative peripheral position. The peripheral displacement is, in the embodiments disclosed, equal to half, or approximately half, the equal outer angular distance between the adjacent outer portions 33.

In the embodiment disclosed, each porthole area 21-24 comprises 9 inner portions 32 and 18 outer portions 33. This is a suitable number of inner portions 32 and outer portions 33. In the embodiments disclosed, the inner angular distance is about twice the outer angular distance. It is to be noted however, that the number of inner portions 32 and the number of outer portions 33 can vary and deviate from the numbers disclosed.

Figure 8:
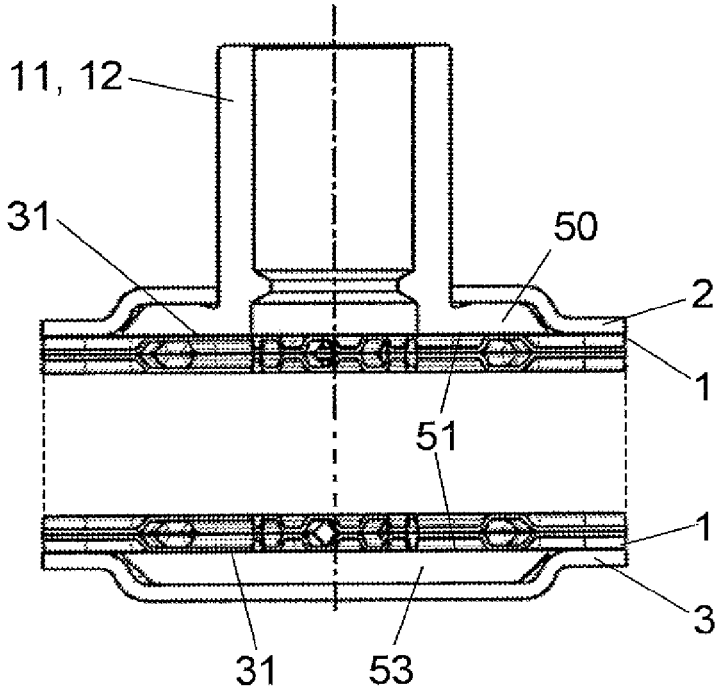
FIG. 8 shows a sectional view through a part of the porthole S1 of the plate heat exchanger in FIG. 1.
Figure 9:
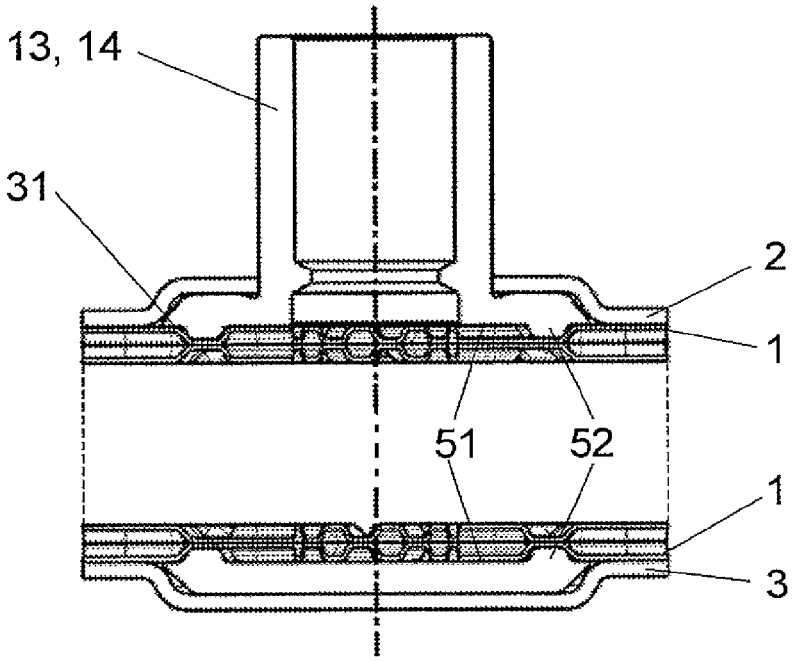
FIG. 9 shows a sectional view through a part of the porthole S3 of the plate heat exchanger in FIG. 1.

Each of the four connection pipes 11-14 is joined to a respective one of the porthole areas 21-24 and comprises a flat element 50. Each flat element 50 forms an attachment flange attached to or integral with a respective connection pipe 11-14 and joined to the plate package, see FIGS. 8 and 9. All of the flat elements 50 are provided between one of the end plates 2, 3 and one of the outermost heat exchanger plates 1. More specifically, in the embodiments disclosed, each flat element 50 is provided between one of the outermost heat exchanger plates 1 and the first end plate 2. The flat elements 50 are brazed to the outermost heat exchanger plate 1 and the first end plate 2. The area around each porthole of the first end plate 2 is raised at a raised portion 2*a* to provide a space for the respective flat element 50 as can be seen in FIGS. 1, 8 and 9. With respect to the first and second porthole S1 and S2, the flat element 50 has a flat, or a substantially flat, bottom surface 51 abutting and joined to the annular flat area 31 of the outermost heat exchanger plate 1 at the first porthole area 21 and the second porthole area 22, respectively. The annular flat area 31 is thus located at the primary level p', see FIG. 8.

With respect to the third and fourth portholes S3, S4, each flat element 50 comprises an annular protrusion 52 projecting from the flat bottom surface 51 and turned towards the plate package. The annular protrusion 52 tightly abuts the annular flat area 31 of the outermost heat exchanger plate 1 at the third porthole area 23 and the fourth porthole area 24, respectively. The annular flat area 31 is thus located at the secondary level p", see FIG. 9. Consequently, a secure and tight abutment of the flat elements 50 is ensured for all of the portholes S1-S4.

Between the second end plate 3 and the other outermost heat exchanger plate 1, there is provided a flat element 53 forming a strengthening washer 53. The flat elements 53 do not form a part of a connection pipe 11-14 and cover the respective porthole. The flat element 53 for the portholes S1 and S2 has a flat, or substantially flat, bottom surface 51 tightly abutting and joined to the annular flat area 31 of the other outermost heat exchanger plate 1 in the same way as the flat element 50. The flat element 53 for the portholes S3 and S4 has a flat bottom surface 51 with an annular protrusion 52 tightly abutting and joined to the annular flat area of the other outermost heat exchanger plate 1. Also the second end plate 3 has a raised portion 3*a* around each porthole.

It is to be noted that one or more of the flat elements 53 may be replaced by a respective connection pipe having a flat element 50 in case an inlet and/or an outlet is to be provided as an alternative or supplement through the second end plate 3.

Figure 10:
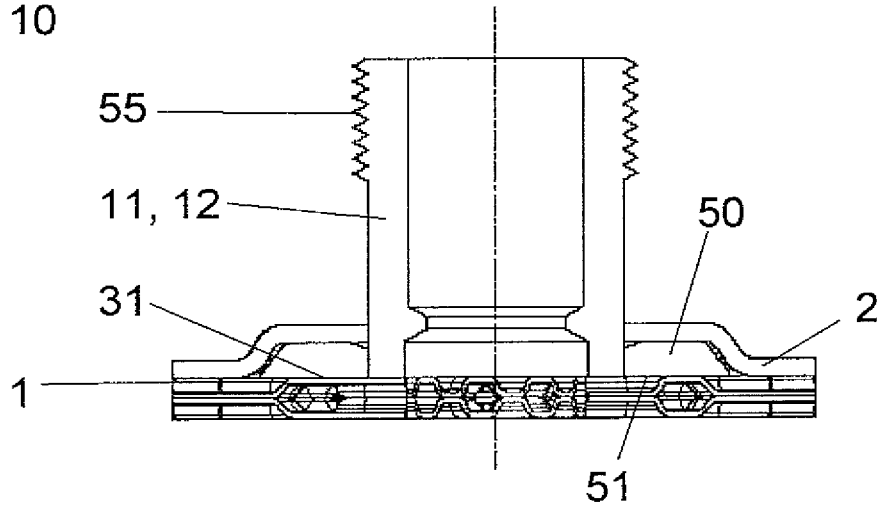
FIG. 10 shows a sectional view similar to the one in FIG. 8 of another embodiment.
Figure 11:
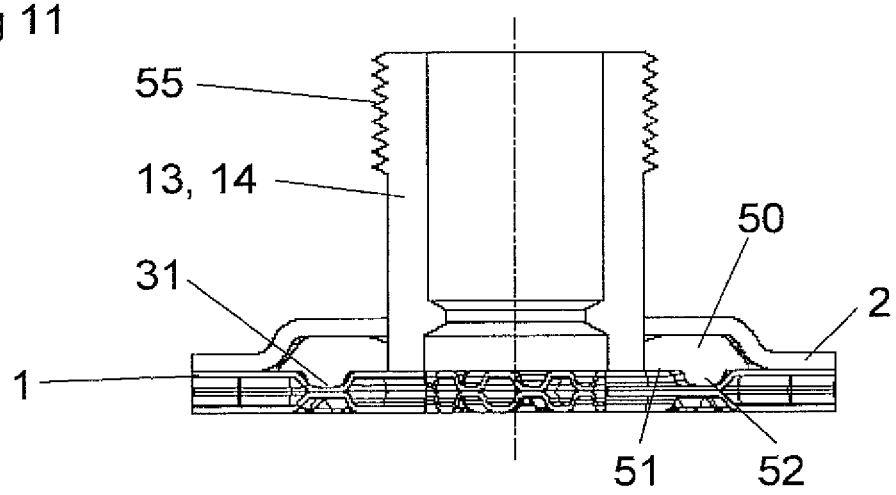
FIG. 11 shows a sectional view similar to the one in FIG. 9 of the other embodiment.

FIGS. 10 and 11 disclose a further embodiment which differs from the embodiment disclosed in FIGS. 8 and 9 merely in that the connection pipe 11-15 comprises an external thread 55 and that the flat element 50 is brazed to the connection pipe 11-15. In such a way, the flat element 50 can be disposed between the outermost heat exchanger plate 1 and the first end plate 2. The connection pipe 11-15 may thereafter be introduced into the respective porthole to be brazed to the flat element 50 in connection with the brazing of the plate heat exchanger.

The present invention is not limited to the embodiments disclosed but may be varied and modified within the scope of the following claims.

The invention claimed is:

1. A plate heat exchanger comprising a plurality of heat exchanger plates, which are made through forming of a metal sheet and are provided beside each other and permanently joined to each other by a braze material to form a plate package having first plate interspaces configured to accommodate a first medium and second plate interspaces configured to accommodate a second medium, at least one of the first medium and the second medium being carbon dioxide, wherein each heat exchanger plate has a pattern forming a heat transfer area, a plurality of porthole areas, each porthole area surrounding a respective porthole defined by a porthole edge, wherein each heat exchanger plate defines a longitudinal centre line and wherein the heat transfer area comprises ridges and valleys arranged in such a manner that the ridges of one of the heat exchanger plates abut the valleys of an adjoining one of the heat exchanger plates to form a plurality of joining areas, wherein each heat exchanger plate extends along a main extension plane, wherein said heat transfer area and said porthole areas, on one side of the heat exchanger plate, extend between an upper, primary level at a distance from the main extension plane and a lower, secondary level at a distance from and on an opposite side of the main extension plane, wherein each heat exchanger plate has a depth defined by the distance between the upper, primary level and the lower, secondary level, wherein the depth is equal to or less than 0.90 mm, wherein the ridges are disposed at a distance from and extend in parallel with each other, and wherein the distance between adjacent ridges on the heat transfer area is less than 4 mm.

2. A plate heat exchanger according to claim 1, wherein the depth is equal to or less than 0.85 mm.

3. A plate heat exchanger according to claim 1, wherein the depth is equal to or less than 0.80 mm.

4. A plate heat exchanger according to any one of the preceding claims, wherein each heat exchanger plate, before the forming, has a metal sheet thickness (t), which lies in the range $0.2 \leq t \leq 0.4$ mm.

5. A plate heat exchanger according to claim 4, wherein the metal sheet thickness (t) is approximately 0.3 mm.

6. A plate heat exchanger according to claim 1, wherein the braze material has a braze volume with respect to the heat transfer area of the plate heat exchanger, wherein the first interspaces and the second interspaces have an interspace volume with respect to the heat transfer area of the plate heat exchanger, and wherein the proportion of the braze volume to the interspace volume is at least 0.05.

7. A plate heat exchanger according to claim 1, wherein the ridges and valleys extend along at least one extension line forming an angle $\alpha$ of inclination with the centre line and wherein the angle $\alpha$ of inclination lies in the range $20° \leq \alpha \leq 70°$.

8. A plate heat exchanger according to claim 7, wherein the angle $\alpha$ of inclination is approximately 45°.

9. A plate heat exchanger according to any one of claims 7 and 8, wherein the extension line of each ridge and valley forms a positive angle $\alpha$ of inclination at one side of the centre line and a corresponding negative angle $\alpha$ of inclination at the other side of the centre line, and wherein the ridges and valleys form joining areas at the centre line.

10. A plate heat exchanger according to claim 1, wherein the distance between adjacent ridges on the heat transfer area is approximately 3 mm.

11. A plate heat exchanger according to claim 1, wherein the porthole areas comprise a first porthole area, a second porthole area, a third porthole area and a fourth porthole area.

* * * * *